US005799348A

United States Patent [19]

Hsu

[11] Patent Number: 5,799,348

[45] Date of Patent: Sep. 1, 1998

[54] HAMMOCK

[76] Inventor: Ker-Shin Hsu, 55-1, Ting Hsin Road, Ting Hsin Village, Sun Kang Hsiang, Chan Hua Hsien, Taiwan

[21] Appl. No.: 958,079

[22] Filed: Oct. 27, 1997

[51] Int. Cl.[6] ..... A45F 3/22

[52] U.S. Cl. ..... 5/123; 5/122

[58] Field of Search ..... 5/123, 120, 121, 5/122

[56] References Cited

U.S. PATENT DOCUMENTS 384,728 6/1888 Thomas ..... 5/123

468,576 2/1892 Palmer ..... 5/123

4,162,550 7/1979 Willingham ..... 5/120

*Primary Examiner*—Alexander Grosz

*Attorney, Agent, or Firm*—Harrison & Egbert

[57] ABSTRACT

A hammock is composed of a net, two side ropes fastened to two longitudinal sides of the net, two support rods fastened near the longitudinal ends of the net, and two suspension hooks. The support rods are made up of an upper rod piece and a lower rod piece. The upper rod piece and the lower rod piece form therebetween a net locating recess for locating the net, and two rope holes for locating the two side ropes.

3 Claims, 5 Drawing Sheets

HAMMOCK

FIELD OF THE INVENTION

The present invention relates generally to a backyard accessory. More particularly, the present invention relates to hammocks.

BACKGROUND OF THE INVENTION

As shown in FIG. 1, a prior art hammock comprises a net 11, two side ropes 12, a plurality of clews 13, and two support rods 14 each having a plurality of position limiting holes 15.

The prior art hammock described above is defective in design in that it is complicated in construction and is therefore not cost-effective. In addition, the net 11 is not held in a balanced way. This can cause discomfort to a person lying in the net 11. Moreover, the prior art hammock is in fact not safe in view of its defective design making its user vulnerable to falls.

SUMMARY OF THE INVENTION

The primary objective of the present invention is to provide an improved hammock which is cost-effective and free from safety hazards.

In keeping with the principle of the present invention, the foregoing objective of the present invention is attained by an improved hammock, which includes a net, two side ropes, two support rods, and two suspension hooks. The net is retained and located by two side ropes and the two support rods. The two suspension hooks are fastened respectively with the triangular end portions of the net.

The foregoing objective, features and functions of the present invention will be more readily understood upon a thoughtful deliberation of the following detailed description of an embodiment of the present invention with reference to the accompanying drawings.

DETAILED DESCRIPTION OF THE EMBODIMENT

Figure 1:
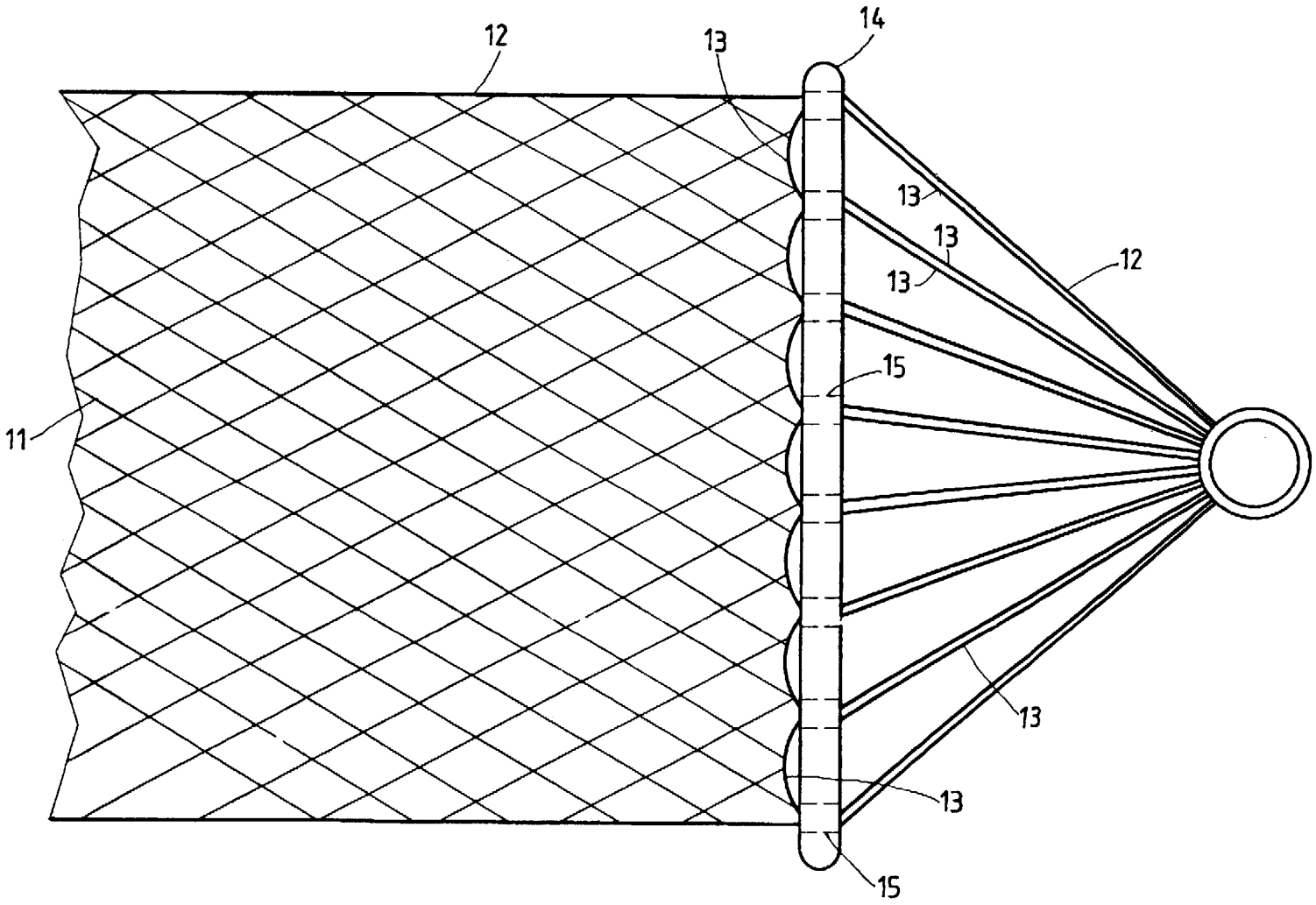
FIG.1 PRIOR ART
FIG. 1 shows a partial top plan view of a hammock of the prior art.
Figure 2:
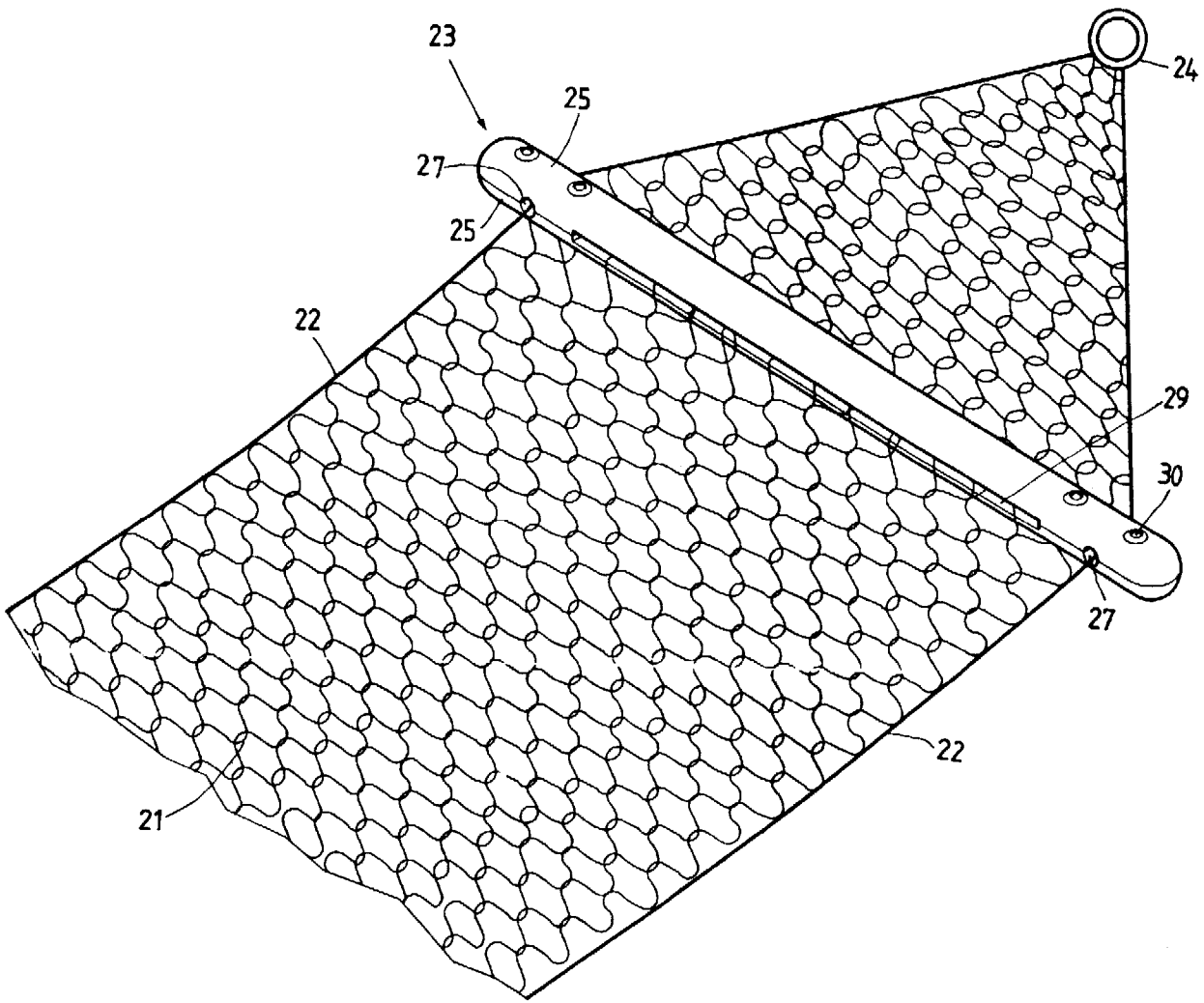
FIG. 2 shows a partial top plan view of a hammock of the present invention.

As shown in FIGS. 2–5, a hammock embodied in the present invention is composed of a net 21, two side ropes 22, two support rods 23, and two suspension hooks 24. For illustrative purposes, only one support rod 23 and one suspension hook 24 are shown in the drawings.

The net 21 has an appropriate size to accommodate at least one person. The net 21 is retained and located along its long sides by two side ropes 22. The net 21 is further retained and located by two support rods 23. Both longitudinal ends of the net 21 are fastened respectively with a suspension hook 24. The net 21 has two triangular portions located between the support rods 23 and the suspension hooks 24.

Figure 3:
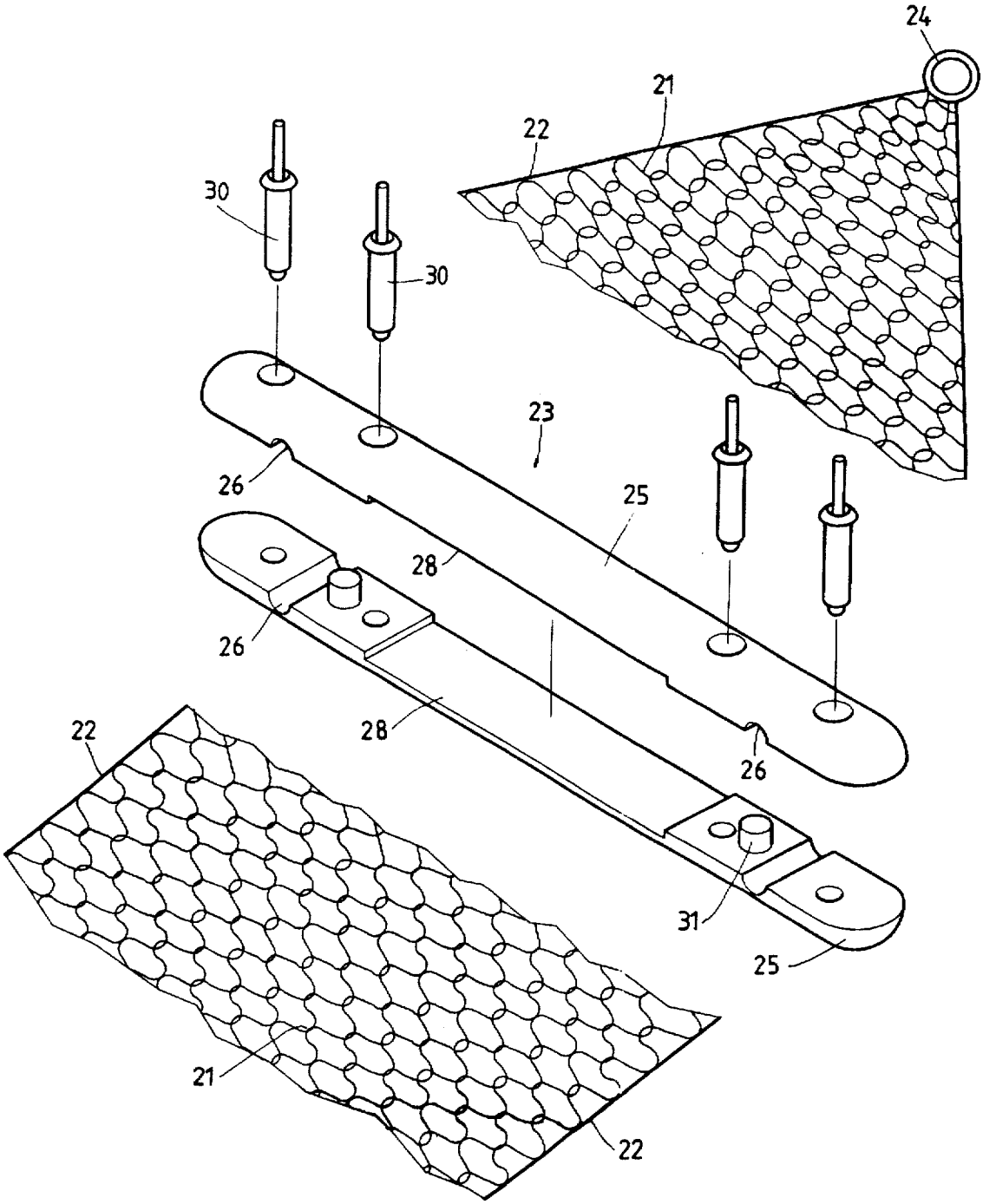
FIG. 3 shows a partial exploded view of the hammock of the present invention.
Figure 4:
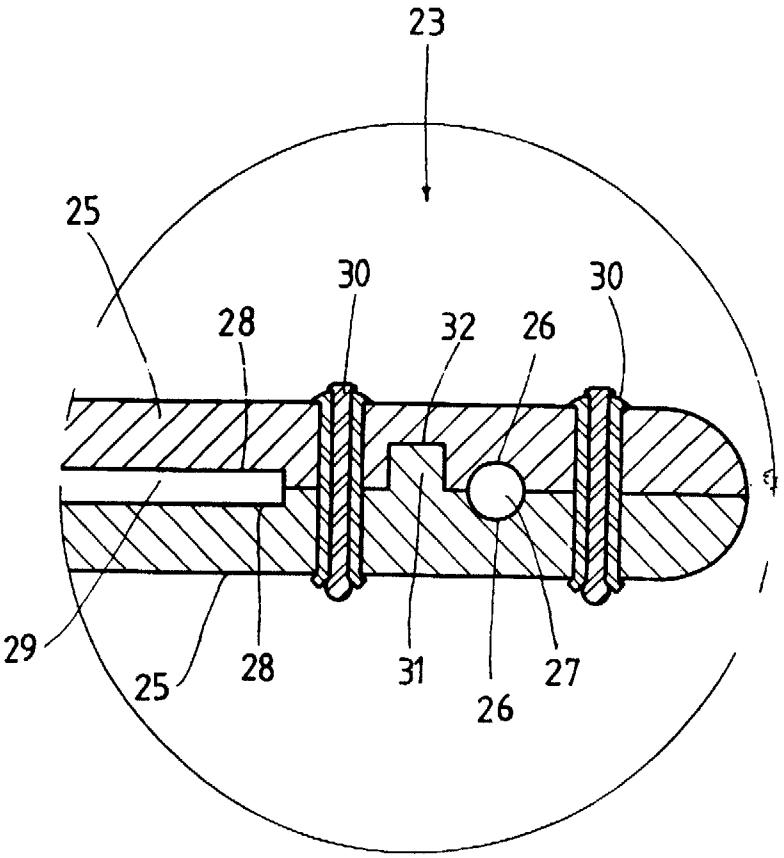
FIG. 4 shows a partial sectional view of the hammock of the present invention.
Figure 5:
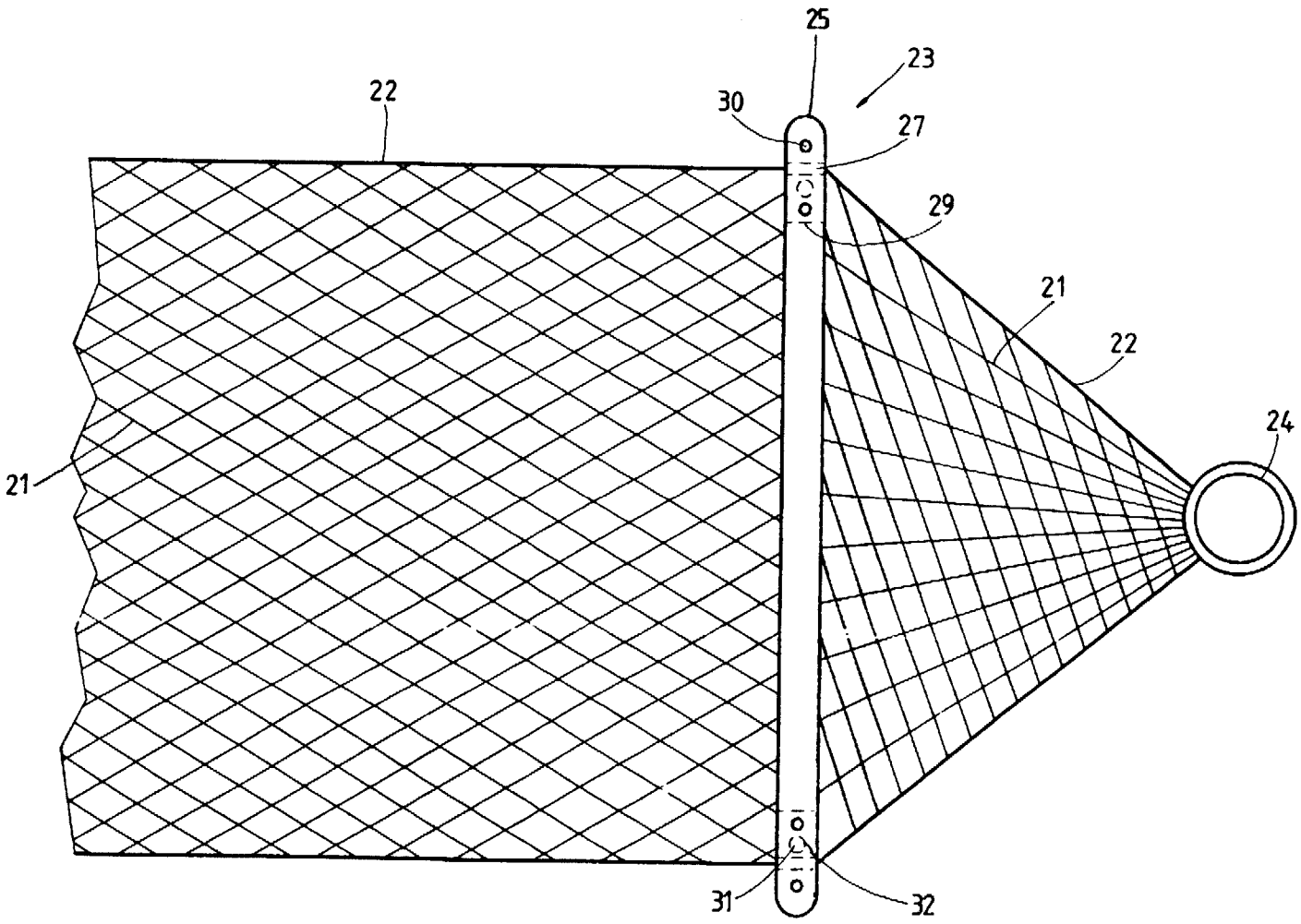
FIG. 5 shows another partial top plan view of the hammock of the present invention.

The present invention is characterized in design in that each of the two support rods 23 is made up of two rod pieces 25, as shown in FIG. 3. The upper rod piece 25 is provided in the underside thereof with two arcuate recesses 26 and a flat recess 28 located between the two arcuate recesses 26. Similarly, the lower rod piece 25 is provided in the upper side thereof with two arcuate recesses 26 and a flat recess 28 located between the two arcuate recesses 26. In combination, the arcuate recesses 26 of the upper and the lower rod pieces 25 join together to form a rope hole 27, whereas the flat recesses 28 of the upper and the lower rod pieces 25 join together to form a net locating slot 29. In addition, the upper rod piece 25 is provided in the underside thereof with two mortises 32, whereas the lower rod piece 25 is provided in the upper side thereof with two tenons 31 corresponding in location to and engageable with the mortises 32 of the upper rod piece 25. Both upper and lower rod pieces 25 are provided with a plurality of fastening through holes engageable with a tension nail 30, as shown in FIGS. 3 and 4.

As illustrated above, the hammock of the present invention is relatively simple in construction and is therefore cost-effective. In addition, the net 21 of the present invention is retained and located securely by two support rods 23 such that the net 21 is securely located in the net locating slot 29, and that the longitudinal margins of the net 21 and the side ropes 22 are located securely in the rope holes 27 of the support rods 23.

It must be noted here that two rod pieces 25 of the support rod 23 are held securely together by the mortises 32, the tenons 31, and the tension nails 30.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A hammock comprising:

a net;

two side ropes fastened to two longitudinal sides of said net;

two support rods fastened with said net such that said two support rods are separated from each other by a distance; and two suspension hooks fastened to both longitudinal ends of said net;

wherein each of said two support rods comprises an upper rod piece and a lower rod piece, said upper rod piece provided in an underside thereof with two arcuate recesses separated from each other by a distance, said upper rod piece further provided in the underside thereof with a flat recess located between said two arcuate recesses, said upper rod piece still further provided with a plurality of fastening through holes engaged with a plurality of fastening nails, said lower rod piece provided in an upper side thereof with two arcuate recesses corresponding in location to said arcuate recesses of said upper rod piece, said lower rod piece further provided in the upper side thereof with a flat recess corresponding in location to said flat recess of said upper rod piece, said lower rod piece still further provided with a plurality of fastening through holes corresponding in location to said fastening through holes of said upper rod piece and engaged with said fastening nails, whereby when said two arcuate recess of said upper rod piece and said two arcuate recesses of said lower rod piece are joined together, they form two rope holes adapted to accommodate said side ropes.

2. The hammock as defined in claim 1, wherein said flat recess of said upper rod piece and said flat recess of said lower rod piece are joined together to form a net locating slot; wherein said net has two triangular portions located between said support rods and said suspension hooks such that one side of each of said two triangular portions of said net is located in said net locating slot of said support rod.

3. The hammock as defined in claim 1, wherein said upper rod piece is provided in the underside thereof with a plurality of mortises; and wherein said lower rod piece is provided in the upper side thereof with a plurality of tenons engaged with said mortises of said upper rod piece.

* * * * *